United States Patent [19]

Dwyer

[11] 3,938,457

[45] Feb. 17, 1976

[54] TANKER HULL MODIFICATION

[75] Inventor: Stanley J. Dwyer, Tredyffrin Township, Pa.

[73] Assignee: Gulf Oil Corporation, Pittsburgh, Pa.

[22] Filed: Dec. 30, 1974

[21] Appl. No.: 537,567

[52] U.S. Cl. ..... 114/56; 114/74 R

[51] Int. Cl.[2] ..... B63B 1/00; B63B 25/08

[58] Field of Search..... 114/56, 74 R, 63, 72, 65 R

[56] References Cited

UNITED STATES PATENTS 3,219,006 11/1965 Vreedenburgh ..... 114/74 R

FOREIGN PATENTS OR APPLICATIONS 348,822 5/1931 United Kingdom..... 114/56

*Primary Examiner*—Trygve M. Blix
*Assistant Examiner*—Sherman D. Basinger

[57] ABSTRACT

In a large ocean going oil tanker vessel having water ballast compartments that cannot be utilized for oil cargo also the amount of ballast water required to submerge the vessel to a predetermined ballast draft is reduced by cutting away a portion of the midbody of the hull starting at and extending below the predetermined ballast draft waterline on the sideshell, thereby reducing the amount of buoyancy in the hull that the ballast weight must overcome to sink the vessel down to the ballast draft.

6 Claims, 9 Drawing Figures

68
66
A

B 32
38
36
34
C
MIDBODY (CONSTANT SECTION)

30

D

E
40

TANKER HULL MODIFICATION

This invention relates to large ocean going tanker vessels that transport liquid such as petroleum crude or refined oil or other bulk cargoes from a loading port to a destination unloading port and then are required to return to a loading port without cargo, thereby making it necessary to take on ballast on the return voyage in order to sink the vessel sufficiently into the water to adequately submerge the propeller and make the vessel manageable, maneuverable and capable of withstanding wind and waves.

In the past, tankers have utilized water ballast in cargo oil tanks from which the oil had previously been discharged. The oil which had been emptied from the tanks left an oily residue on the inner surfaces and structural members of the tanks. This oily residue mixed into the water ballast with the result that when the water ballast was emptied from the cargo tanks into the sea to make the tanks available for another loading of cargo oil the discharged oily water ballast became a source of oil pollution of the seas. There is a worldwide effort to stop or minimize this pollution of the seas, and international maritime law relulations to this end are, or shortly will be, in effect.

Under these regulations tankers and bulk carriers will no longer be able to discharge oily ballast water into the sea. If large tanker vessels must take on ballast seawater, this ballast will be carried in separate or segregated ballast tanks into which no previous cargo oil or other product had been carried, so that when it is discharged back into the sea it will be clean ballast. If the ballast must be taken into cargo tanks under emergency weather conditions when ballast requirements are unusually great so that the ballast becomes dirty and cannot be purified, then the ballast will be discharged into shore tanks. In either case, ballasting a vessel becomes an added operational expense because the ballasting compartments constitute a permanent reduction in cargo space. The expense associated with ballast increases directly with the amount of ballast provided for and handled, which produces no revenue.

This invention is intended to reduce the amount of ballast space necessary to sink a vessel to a normally adequate ballast draft. There are no exact criteria for establishing universally what the ballast draft should be since this will vary with the size of vessel and conditions of sea and weather. In one determination, through collection of actual operating data for a large number of vessels over a long period of time, it has been empirically determined that a mean ballast draft of $(0.02L + 2)$ meters, where $L$ is the length of the vessel in meters, represents a generally acceptable average.

According to this invention, the amount of ballast seawater that must be taken on by the vessel to achieve a predetermined required ballast draft is reduced by cutting away a portion of the midbody of the vessel starting substantially at and extending below the required ballast draft waterline, thereby reducing the amount of buoyancy in the hull that the ballast weight must overcome to sink the vessel down to the ballast draft. Because the cutaway portion does not extend above the ballast draft waterline it does not reduce the cargo capacity of the vessel. Since the cutaway portion starts essentially at the ballast waterline it tends to maximize the volume of the hull which is cut away without reducing the cargo capacity of the vessel. In this manner, buoyancy is taken away from the hull form, thereby requiring less ballast or weight to submerge the vessel to a specified ballast draft, without reducing the cargo payload capacity of the vessel. Accordingly, starting at a waterline height of $(0.02L + 2)$ meters above the hull baseline, or at a waterline height above the hull baseline determined by any other formula, the sideshell of the vessel is sloped downward and inboard to form a suitable angle with the hull baseline. An angle of slope of 30° with respect to the baseline represents a practical angle from a shipbuilding consideration, although the slope with respect to the baseline can vary between 10° and 70°. Other angular measures, or even curved cutaways, can be used. In any case, cutting away the hull starting at what is considered a general average ballast draft means that maximum buoyancy is taken away from the hull form, thereby requiring less ballast or weight to submerge the vessel to the ballast draft, without reducing the cargo carrying capacity of the vessel.

In addition to the cutaway of the hull buoyancy as described, a fixed ballast material of a higher density than seawater, such as cement or concrete, can also be installed in the tanker or bulk carrier. Use of a solid or liquid ballast which is denser than water will permit the required volume for ballast to be reduced by a factor which is the ratio of the density of water to the density of the heavier ballast. Adding the fixed weight means that more interior tank cubic capacity can be designated for cargo while still achieving the required ballast draft. However, use of a fixed ballast has the disadvantage that when the vessel is carrying payload, power is consumed to transport the fixed ballast. This is not the case with disposable water ballast.

The initial overall advantage of the cutaway hull of this invention is that less ballast water is required to be handled by the ship, and expenses and time associated with ballast water are accordingly reduced.

Another advantage is that since the capacity of the ballast tanks is reduced, the size of the vessel is likewise reduced so that there is a savings in construction cost.

Still another advantage relates to the practice of coating the internal surfaces of ballast tanks with a protective coating so that the salt water will corrode the steel. A reduction in ballast tank capacity in accordance with this invention will mean a saving in coating costs.

A further advantage is apparent because of a current proposal that tankers be designed with a double bottom to prevent outflow of oil to the sea in the event the bottom shell is ruptured due to grounding. This invention, with a large removal of the hull bottom, would greatly reduce the extent of the double bottom plating required, thereby effecting a large saving in construction costs.

A further potential advantage is that because of the cutaway feature there is a diminished protrusion of the lower hull below the waterline, thereby making the vessel less vulnerable to the possibility of striking a submerged object, damaging the hull and opening the tanks to the sea.

Another advantage of this invention is that since the displacement of the cutaway hull of this invention at the ballast draft will be substantially less than with a conventional hull with the same principal dimensions and about the same payload capacity operating at the same ballast draft, the cutaway hull will permit a significant increase in speed for the same amount of propelling power, or if the speeds of the two different types of hulls are kept the same, the cutaway hull will require less propelling power with the associated savings in fuel costs.

The effects of the various singular advantages of the cutaway hull are cumulative and the net results is that there will be a substantial savings in transportation costs in any commodity carried in such a vessel wherein separate, mutually exclusive and non-interchangeable ballast and payload compartments must be provided. This invention is particularly directed to vessels utilizing a liquid ballast, such as seawater, and a liquid payload, such as oil.

It is readily apparent that other cutaway configurations than illustrated herein will accomplish the principle and provide the advantages of the present invention.

Figure 1:
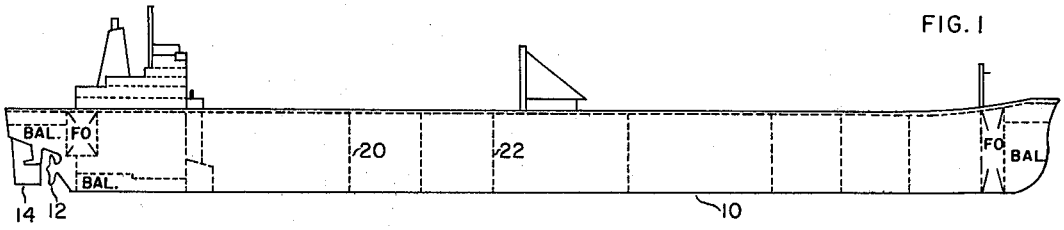
FIG. 1 shows a side view of a tanker with compartments designated only for a ballast.
Figure 2:
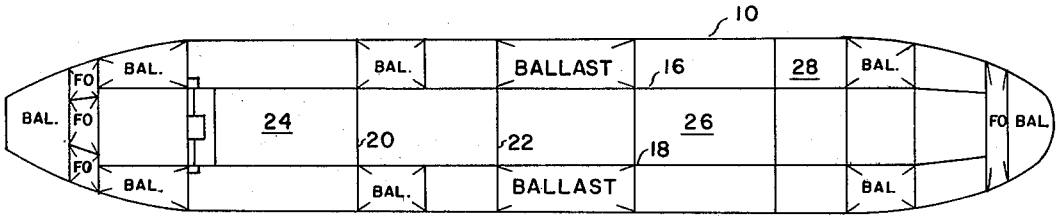
FIG. 2 shows a top view of the tanker of FIG. 1.

FIGS. 1 and 2 show side and top views, respectively, of a tanker hull 10 having a propeller 12 and a rudder 14. The inside of the hull is partitioned into compartments by means of a plurality of bulkheads of which longitudinal partitions of bulkheads 16 and 18 and transverse partitions or bulkheads 20 and 22 are typical. The bulkheads define individual separate compartments, of which the compartments employed for seawater ballast only are designated in FIG. 2. The compartments utilized for fuel oil to power the vessel are also designated in FIG. 2. The remaining compartments of which 24, 26 and 28 are typical, are utilized for payload oil cargo only.

Figures 3, 3A, 3B, 3C, 3D, 3E:
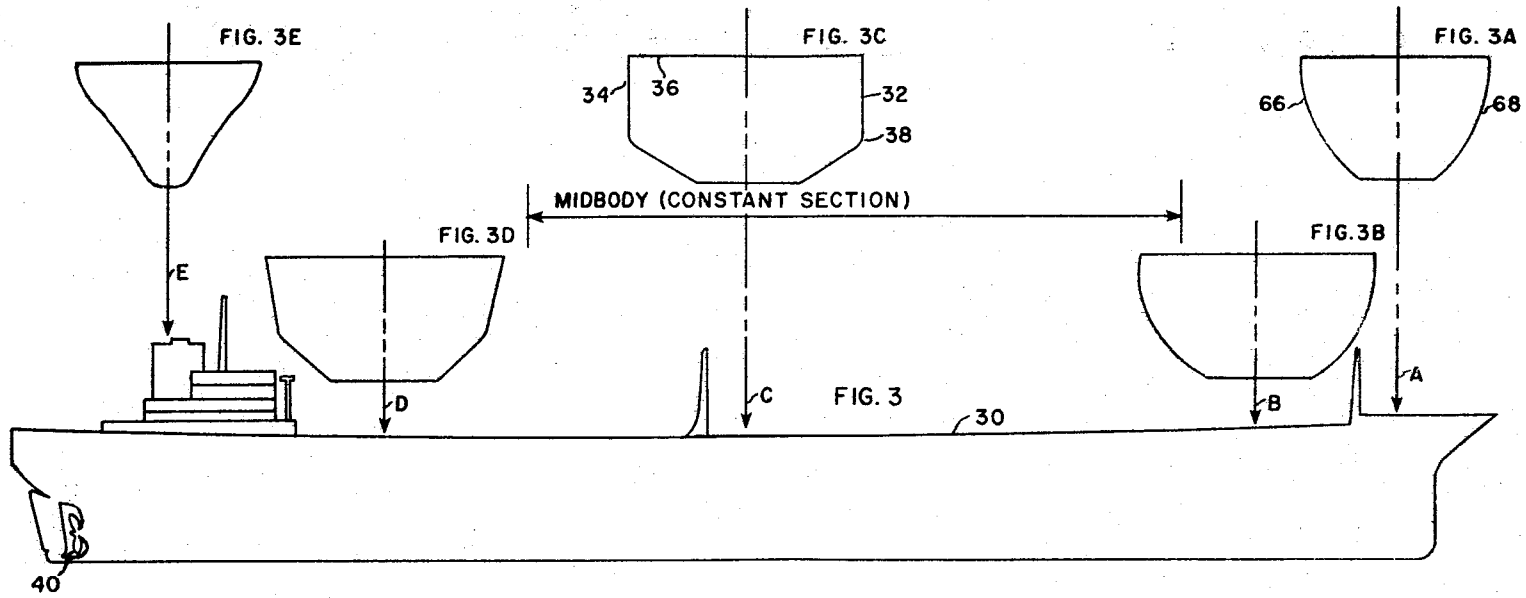
FIG. 3 shows a tanker with a cutaway hull.
FIGS. 3A–3E show sectional views of the tanker of FIG. 3.

FIG. 3 shows a side view of another hull 30 with positions A, B, C, D and E indicated along the length of the hull and with FIGS. 3A, 3B, 3C, 3D and 3E indicating the progressively changed cross-sectional configurations of the hull at each of said positions.

FIG. 3A shows that at its forward section the hull is relatively narrow and sideshells 66 and 68 are curved over substantially their entire depths to enable the hull to break the water with a diminished resistance.

FIG. 3B shows that closer to its midbody, the hull becomes wider, but the sidewalls remained curved to retain a streamlined effect.

FIG. 3C shows the cross-section of the hull along the hull midbody. The midbody extends alont the longitudinal middle section of the hull for about 5 to 80 percent of the hull length, and typically for about 15 to 60 percent of the hull length. The midbody need not be symetrical with respect to the exact mid-length of the hull. The midbody of the hull is the widest portion of the hull, it represents most of the displacement of the hull and has vertical or nearly vertical sideshells 32 and 34 extending downwardly from deck 36 to the minimum mean ballast draft waterline 38 to enable the hull midbody to enclose the greatest possible payload volume. The cross-section hull configuration shown in FIG. 3C remains constant along substantially the entire midbody of the hull length indicated by the horizontal arrows under FIG. 3C.

FIGS. 3D and 3E show progressive changes in hull cross-sectional configuration in moving rearwardly from the midsection of the hull. FIGS. 3D and 3E show that the hull progressively departs from the constant cross-section sideshell configuration and becomes progressively narrower with the sideshells assuming a progressively more curved configuration. This change in hull configuration enables the hull to direct displaced seawater towards propeller 40 in order to insure efficient propeller operation.

Figure 4:
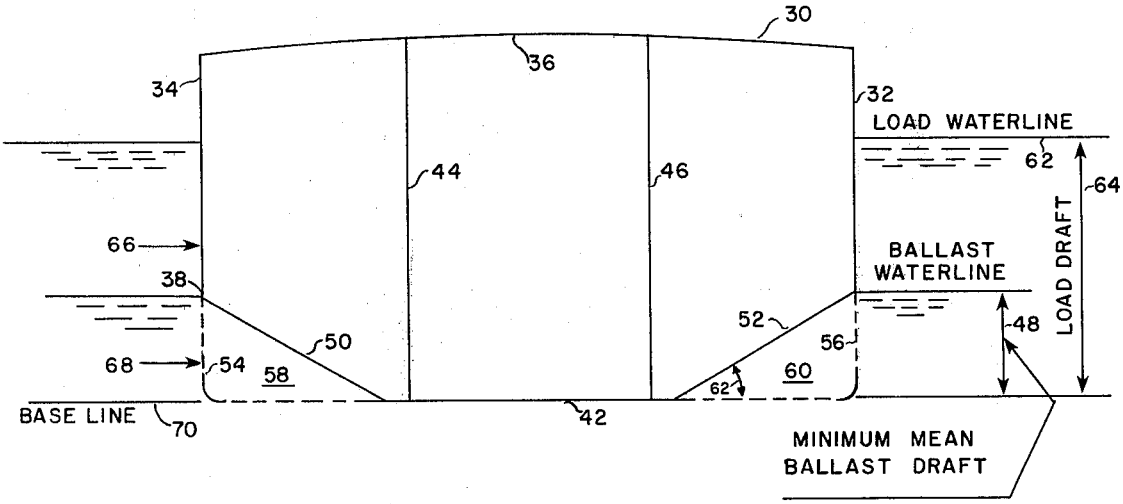
FIG. 4 shows a sectional view of a cutaway tanker.

The midbody of the hull is the greatest longitudinal length of the hull along which the cross-section configuration of the hull remains constant. FIG. 4 represents a more detailed view of the midbody cross-section of hull 30 shown in FIG. 3C. As shown in FIG. 4, vertical, or nearly vertical, sideshells 32 and 34 (which are essentially parallel to each other) extend downwardly from deck 36 to ballast waterline 38. The bottom shell of the hull is indicated at 42 with bulkheads 44 and 46 extending between deck 36 and bottom shell 42 to define individual ballast and cargo compartments. The line 70, which is the line of bottom shell 42 extended, is the hull baseline and is the line from which drafts are measured and from which the slope angle of the cutaway is measured.

FIG. 4 shows that the sideshells 32 and 34 are vertical, or nearly vertical, from deck 36 to ballast waterline 38, which is at a distance 48 from the bottom shell. Distance 48 represents the minimum mean ballast draft of the vessel and this distance is established by a formula, such as is discussed above. Inclined lines 50 and 52 define the cutaway hull configuration of this invention and extend between ballast waterline 38 and bottom shell 42. Broken lines 54 and 56 represent the conventional midbody hull configuration so that the cutaway volumes 58 plus 60 represent the reduced displacement and, therefore, the savings in ballast volume in the vessel to achieve a minimum ballast depth 48, without reducing the payload volume of the vessel. Arc 62 represents the angle of inclination with respect to the bottom shell of the cutaway sections.

FIG. 4 indicates that the fully loaded vessel is submerged along most of the depth of the sidewalls to a load waterline 62 which is at a load draft 64. Load draft 64 is considerably greater than minimum mean ballast draft 48 since it represents the draft of the vessel with all or most of the cargo compartments full, although the ballast compartments will generally be empty when the vessel is carrying a full payload in order to conserve power. As shown in FIG. 4, the volume enclosed by the hull above the ballast waterline is substantially greater than the volume enclosed by the hull below the ballast waterline.

It is to be noted that if cutaway lines 50 and 52 were to extend to some position 66 on the sideshell between the load waterline and the ballast waterline, the cutaway would disadvantageously reduce the payload capacity of the vessel while reducing the required ballast volume. On the other hand, if the cutaway lines 50 and 52 extended only to a position 68 below the minimum ballast waterline, the possible savings of ballast volume in accordance with this invention would be reduced. Therefore, by extending cutaway lines 50 and 52 directly to ballast waterline 38, the greatest reduction in ballast volume is achieved without incurring any reduction in payload capacity of the vessel.

I claim:

1. A tanker vessel having a hull and a minimum mean ballast draft depth line on said hull which is defined by a change in width of said hull along the midbody of the hull, the volume enclosed by said hull above said minimum mean ballast draft depth line being substantially greater than the volume enclosed by said hull below said minimum mean ballast draft depth line, the width of the midbody of said hull being substantially uniform above said minimum mean ballast draft depth line and the width of the midbody of said hull progressively decreasing from said mean ballast draft depth line to the bottom of said hull, the interior of said hull partitioned to define a plurality of separate compartments, some of said compartments designated for cargo and others of said compartments designated only for water ballast, the volume enclosed by said hull below said mean ballast draft depth line being substantially the sum of the volume of water displaced by the weight of the vessel plus the volume of the water in said water ballast compartments.

2. The tanker vessel of claim 1 wherein said midbody extends along the longitudinal middle portion of said hull for about 5 to 80 percent of the hull length.

3. The tanker vessel of claim 1 wherein said midbody is the widest portion of said hull.

4. The tanker vessel of claim 1 wherein said midbody is the only region of the hull wherein the width is substantially uniform above said minimum mean ballast draft depth line.

5. The tanker vessel of claim 1 including solid ballast.

6. The tanker vessel of claim 1 wherein said midbody represents most of the displacement of the hull.

* * * * *